United States Patent [19]

Chikuma

[11] 3,999,079

[45] Dec. 21, 1976

[54] FIRE DETECTOR

[76] Inventor: Toichi Chikuma, No. 4-11-9-703, Sendagaya, Shibuya, Tokyo, Japan

[22] Filed: Dec. 17, 1975

[21] Appl. No.: 641,579

Related U.S. Application Data

[63] Continuation-in-part of Ser. No. 537,422, Dec. 30, 1974, abandoned, which is a continuation-in-part of Ser. No. 381,332, July 20, 1973, abandoned.

[30] Foreign Application Priority Data

July 27, 1972 Japan ..... 47-74762

[52] U.S. Cl. ..... 307/117; 340/227 R; 340/228 R

[51] Int. Cl.[2] ..... H01H 37/32

[58] Field of Search ..... 307/117, 152; 328/127, 328/132; 340/227 R, 228 RF, 228.1, 228.2

[56] References Cited

UNITED STATES PATENTS

| | | | |
|---|---|---|---|
| 2,944,152 | 7/1960 | Johnson et al. | 340/228 R |
| 3,045,183 | 7/1962 | Laczko | 328/132 X |
| 3,621,262 | 11/1971 | Lecuyer | 340/228 R |
| 3,872,449 | 3/1975 | Scheidweiler | 340/228.1 |

*Primary Examiner*—Harry Moose
*Attorney, Agent, or Firm*—Wenderoth, Lind & Ponack

[57] ABSTRACT

The fire detector in which only an increasing component of the voltage produced by a transducer is applied to a timing-circuit and a voltage detected by said transducer is converted in waveform into sawtooth wave form which increases in accordance with the increasing component of said voltage by short-circuiting a capacitor comprising said timing circuit in a predetermined time interval and then the converted voltage is applied to a constant voltage circuit.

2 Claims, 4 Drawing Figures

FIRE DETECTOR

This application is a continuation-in-part of my U.S. application Ser. No. 537,422 filed Dec. 30, 1974 now abandoned, which is a continuation-in-part of Ser. No. 381,332, filed July 20, 1973, now abandoned.

BACKGROUND OF THE INVENTION

The present invention relates to fire detectors, and particularly to improvement of electrical or electronic fire detectors.

Electrical or electronic fire detectors are usually arranged so that so-called physical quantity of heat and combustion products or smoke particles produced by fire is detected, said physical quantity being converted by transducer means to a voltage proportional to said physical quantity. When said voltage reaches a predetermined level, an electrical signal is produced to render alarm means operative. In such fire detectors, fire is recognized as occurring only when the output voltage of said transducer means attains said predetermined level within a certain time constant: In other words, only when the output voltage of said transducer means attains said predetermined level within a rated constant time interval.

In known fire detectors of this kind, the output voltage of transducer means which is applied to a constant voltage circuit through a timing circuit has been a superposition of the direct current component and the increasing component. Therefore, conventional fire detectors have such drawback that an erroneous alarm of fire occurs. This occurs, for example, when the relevant fire sensing area is heated by a room heater and the temperature therein rises slowly rather than rapidly to a predetermined temperature which is recognized by the system as fire, or when any room or compartment and the like is filled with cigarette smoke or dust so that its quantity of particles becomes equal to that recognized by the system as indicative of fire.

SUMMARY OF THE INVENTION

The principal purpose of the invention is to provide an improved fire detector which generates an alarm only when an actual fire occurs and does not result in an alarm upon other external factors.

A further object of the invention is to provide a fire detector which is simple in structure and can easily be manufactured with low cost.

Other objects and features of the invention will be apparent in conjunction with the appended drawings.

DETAILED EXPLANATION OF THE PREFERRED EMBODIMENT

Figure 1:
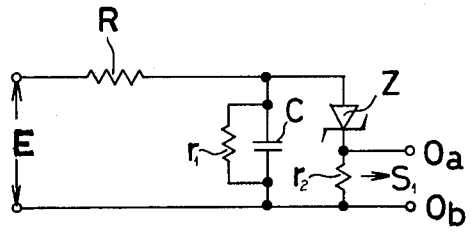
FIG.1 PRIOR ART
FIG. 1 is a schematic diagram of the decision circuit which is the main part of the prior art electrical fire detector.

Referring to FIG. 1, a decision circuit which is a main part of the prior art electrical fire detector is schematically shown. A resistor R and a capacitor C in series constitute a timing circuit and a series combination of a zener diode Z and a resistor $r_2$ in parallel with the capacitor C forms a constant voltage circuit. A protection resistor $r_1$ is connected in parallel with the capacitor C. An output voltage E of a transducer (not shown) which is a superposition of a direct current component and a increasing component is applied to said timing circuit. When the voltage applied to said constant voltage circuit through said timing circuit reaches a predetermined level S, a voltage having a level $S_1$ appears across the resistor $r_2$ and it is applied from output terminals $O_a$ and $O_b$ to alarm means such as a buzzer and the like.

Operational characteristics of the fire detector, as mentioned above, are illustrated in FIG. 2, wherein time $t$ is plotted on the abscissa and voltage E is plotted on the ordinate.

Figure 2:
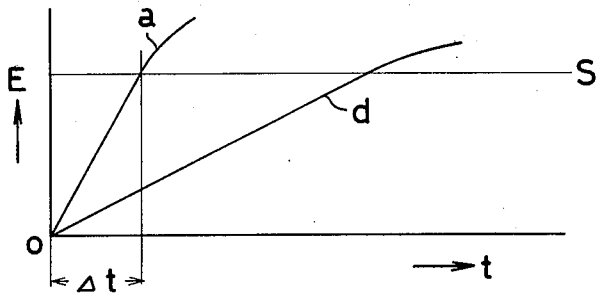
FIG. 2 is a characteristic curve for illustrating the operation of the fire detector shown in FIG. 1.

As can be seen from FIG. 2, when fire breaks out the voltage E across the capacitor C presents a substantially linear and steep rise within the rated time interval $\Delta t$, as indicated by a curve $a$, so that it attains a level equal to or more than the predetermimned constant level S which can activate the zener diode Z.

However, as indicated by a curve a $d$, if temperature or smoke and the like within the associated fire sensing region gradually increases by any cause other than the occurrence of fire, the voltage E across the capacitor C will exceed said constant level S after a time interval considerably longer than $\Delta t$, since an output voltage of superposition of a direct current component and an increasing component generated by the transducer is applied to the capacitor C, resulting activation of the alarm means.

Figure 3:
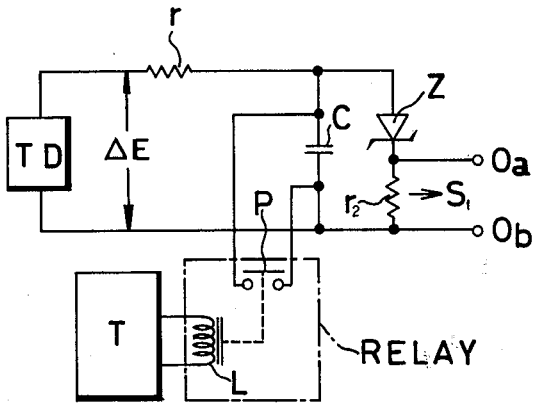
FIG. 3 is a schematic diagram of an embodiment according to the invention.

One preferred embodiment of the fire detector according to the invention which eliminates the above mentioned disadvantages is shown in FIG. 3.

This embodiment is somewhat similar to that of FIG. 1 in that a protection resistor $r$ and capacitor C in series are connected to a well-known transducer TD, and across the capacitor C is connected a constant voltage circuit including a series combination of a zener diode Z and a resistor $r_2$, whereby an output signal $S_1$ is derived from output terminals $O_a$ and $O_b$ when the voltage across said constant voltage circuit reaches the level S.

However, the fire detector of the embodiment differs greatly from conventional ones in that a voltage $\Delta E$ of the increasing component derived by subtracting the direct current component from the output of the transducer TD is applied to said capacitor C and means for repetitively short circuiting said capacitor C with a predetermined period is provided. Namely, the transducer TD includes a capacitor (not shown) connected to said protection resistor r in series in addition to a DC amplifier, whereby only a detected increasing component in voltage which increases exponentially is applied to said capacitor C.

As shown in FIG. 3, the capacitor C is connected in parallel with a normally open relay contact P which is closed or opened by energization or deenergization of a relay winding L connected to a pulse generator T that provides a train of pulses with a constant period.

The pulse generating period of the pulse generator T is set that it is equal to or slightly longer than the rated time interval $\Delta t$ within which the voltage E applied to the capacitor C must reach said constant level S to indicate the existence of fire.

Figure 4:
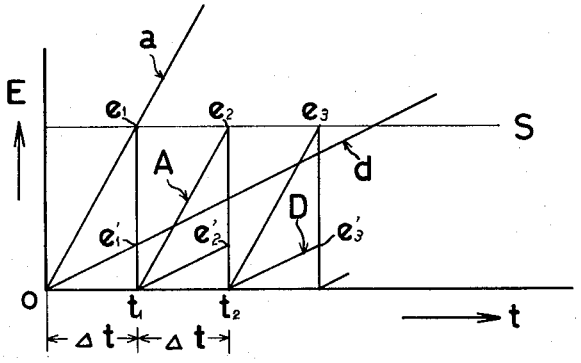
FIG. 4 is a characteristic curve for illustrating the operational manner of the embodiment as illustrated in FIG. 3.

Assuming in the present embodiment that the pulse generating period is set to the time interval $\Delta t$, operation of the fire detector shown in FIG. 3 will be explained by referring to characteristic curves shown in FIG. 4, in which, as in FIG. 2, time $t_1$ is plotted on the abscissa and voltage E is plotted on the ordinate.

Furthermore, the curve *a* represents the variation of the voltage (sum of the direct current component and the increasing component) detected by the transducer TD upon occurrence of fire, and the curve *d* represents the change of the voltage detected by the transducer TD which gradually rises due to causes other than the occurrence of fire. For convenience of explanation, the curves *a* and *d* in FIG. 4 are shown as straight lines.

When the voltage detected by the transducer TD increases as shown by the curve *a*, the voltage applied to the constant voltage circuit and hence the zener diode Z varies in accordance with a sawtooth wave form as shown by curve A due to the short circuit action of the contact P over the constant period for the capacitor C, and for the curve *d* the voltage applied to the constant voltage circuit changes in sawtooth waveform as indicated by curve D.

That is to say, the relay winding L is energized at the end of each period $\Delta t$ by a pulse generator or timer T, and then the relay contact P is closed so that the capacitor C is short-circuited at the end of each period of $\Delta t$. Accordingly, the capacitor C repeats its charging and short-circuiting action with the constant period $\Delta t$ irrespective of increase in the voltage detected by the transducer TD.

Accordingly, when the voltage detected by the transducer TD varies in accordance with the curve *a*, the increasing component $\Delta E$ of said detected voltage excluding the direct current component is applied to the capacitor C, and hence, the voltage applied across the zener diode Z changes in the same manner as the curve *a* during the time interval $\Delta t$ from the time $t = 0$ to the time $t_1$ as shown by the curve A. However, the voltage across the zener diode Z falls abruptly down to zero or substantially zero. Subsequently, during the next time interval $\Delta t$ from the time $t_1$ to the time $t_2$, as the increasing component $\Delta E$ is applied to the capacitor, as mentioned above, the voltage across the zener diode Z rises again at the same rate of increase as that of the curve *a*. At the time $t_2$, the voltage of the zener diode Z drops steeply to zero again. This operation is repeated so that the voltage fed across the zener diode Z is converted to a substantially sawtooth waveform as shown by the curve A when a fire breaks out.

Similarly, if the voltage detected by the transducer varies as indicated by a curve *d*, the voltage applied to the zener diode Z changes in a sawtooth waveform that repetitively rises and falls with the period $\Delta t$ as shown by a curve D.

It should be noted that the rate of increase of the voltage detected by the transducer TD decreases with time. However, in the curve A, at least a portion from the time $t = 0$ to the time $t_1$ shows the same variation as the curve *a* so that only a crest value $e_1$ in at least the time $t_1$ can exceed the predetermined level S, because the timer T is set such that its period of pulse generation is equal to or larger than $\Delta t$.

Thus, when the voltage detected by the transducer TD changes in accordance with the curve *a*, an output $S_1$ is produced from the output terminals $O_a$ and $O_b$ at least at the time $t_1$, thereby enabling the alarm means to be activated.

On the other hand, even if the above-mentioned detected voltage rises in a slow manner as shown by the curve *d* such that it reaches the predetermined level S at a certain time, respective peak values $e'_1, e'_2, e'_3 \ldots$ of the curve D cannot have such high values that amount to the predetermined level S, because the rate of rise in said voltage is not so steep that said voltage attains said level S at any time instance during the period $\Delta t$.

As a result, an output cannot be produced from the output terminals $O_a$ and $O_b$ when the voltage detected by the transducer TD rises along the curve *d*.

In one example of the fire detector in accordance with the present invention, where the period $\Delta t$ of pulses from the pulse generator T is 30 seconds, the resistor *r* is 20–30 Mohms, the leaky capacitance of the capacitor C is 1$\mu$F and the zener voltage of the zener diode Z was $Z_1$ volts, the curve as shown in FIG. 2 is obtained. The terminal voltage of the capacitor C forms a sawtooth waveform where the crest value is somewhat higher than $Z_1$ volts and the period is somewhat shorter than 30 seconds, whereby the output $S_1$ appears, while when the curve *b* is obtained, the terminal voltage C forms a sawtooth waveform where the crest value is always smaller than $Z_1$ and the period is 30 seconds, whereby an output $S_1$ does not appear. An interval resistance of the capacitor C, an additional resistance, for example, as shown in FIG. 1 and connected in parallel to the capacitor C, and a series resistance R constitute a potential divider which acts to decrease the maximum charging value of the capacitor C while also decreasing the total charging time constant for the circuit.

As an alternative, semiconductor switching elements such as transistors and the like instead of electromechanical relays can be used for the switching circuit which controls charging and discharging of the capacitor C by switching action caused by the pulses of the pulse generator T.

While the invention has been described with respect to the preferred embodiment, it will be understood by those skilled in the art that various changes in form and detail may be made therein without departing from the spirit and scope of the invention.

What is claimed is:

1. A fire detector comprising transducer means for producing a voltage proportional to a physical quantity of heat or combustion products and for transmitting only the increasing component of said voltage, pulse generator means for generating a train of pulses with a predetermined constant period, capacitor means connected in parallel with said transducer means and supplied with only the said increasing component of said voltage, switching circuit means connected in parallel with said capacitor means and connected to said pulse generator means so that said capacitor means is short-circuited each constant period by switching action of said switching circuit means, the switching action being caused by the train of pulses from said pulse generator means, and constant voltage circuit means connected in parallel with said capacitor means so that a charging voltage appearing thereacross is applied to said constant circuit means and the latter provides an output when said charging voltage reaches a predetermined value, said constant voltage circuit means being supplied with a sawtooth waveform voltage which falls abruptly due to the short-circuiting of said capacitor means, said sawtooth voltage rising at the same rate of increase as that of the increasing component of said voltage applied to said capacitor during said constant time period and which falls abruptly due to the short-circuiting of said capacitor means after which it again rises at the same rate of increase as that of the increasing component of said voltage during said constant time period.

2. A fire detector as claimed in claim 1 wherein said switching circuit means comprises a relay winding which is connected to said pulse generator means and energized by the pulses therefrom with said constant period, and a relay contact which is closed or opened by energization or deenergization of said relay winding.

* * * * *